US005479664A

United States Patent [19]

Hollander

[11] Patent Number: 5,479,664

[45] Date of Patent: Jan. 2, 1996

[54] MATTRESS COVER

[76] Inventor: Jeffrey M. Hollander, 4700 Leitner Dr. N., Coral Springs, Fla. 33067

[21] Appl. No.: 249,756

[22] Filed: May 26, 1994

[51] Int. Cl.[6] ..... A47G 9/02

[52] U.S. Cl. ..... 5/499; 5/497

[58] Field of Search ..... 5/496, 497, 499, 5/500

[56] References Cited

U.S. PATENT DOCUMENTS

| | | | |
|---|---|---|---|
| 2,162,755 | 6/1939 | Shauer . | |
| 2,214,074 | 9/1940 | Clarke | 5/499 |
| 2,528,313 | 10/1950 | Kessler . | |
| 2,569,627 | 10/1951 | Black . | |
| 2,624,893 | 1/1953 | Harris . | |
| 2,639,444 | 5/1953 | De Monsabert . | |
| 2,662,234 | 12/1953 | Citron | 5/497 |
| 2,856,615 | 10/1958 | Cirocco . | |
| 2,857,643 | 10/1958 | Tomsic | 5/496 X |
| 2,942,280 | 6/1960 | May, Jr. . | |
| 3,020,566 | 2/1962 | Anderson et al. . | |
| 3,114,156 | 12/1963 | Cobb . | |
| 3,273,175 | 9/1966 | Anderson et al. . | |
| 3,789,441 | 2/1974 | Weiss . | |
| 4,461,049 | 7/1984 | Hammond | 5/496 X |
| 4,672,702 | 6/1987 | Isham . | |
| 4,682,555 | 7/1987 | Bierbaum . | |
| 4,703,530 | 11/1987 | Gusman . | |
| 4,727,608 | 3/1988 | Joyce . | |
| 4,768,252 | 9/1988 | Ross | 5/497 |
| 4,825,489 | 5/1989 | Ross | 5/497 |
| 4,937,904 | 7/1990 | Ross | 5/497 |
| 5,249,322 | 10/1993 | Seago . | |

*Primary Examiner*—Michael F. Trettel

*Attorney, Agent, or Firm*—Lerner, David, Littenberg, Krumholz & Mentlik

[57] ABSTRACT

A mattress cover consists of a top panel, a skirt, an edge elastic and a peripheral elastic. The top panel is adopted for covering of at least a substantial portion of a top surface of a mattress. The skirt extends outwardly from the top panel forming an enclosure for at least portions of side and end surfaces of the mattress. The skirt has a distal edge remote from the top panel. An opening situated at the distal edge is provided. The edge elastic forms a resilient boundary of the opening. The peripheral elastic urges the edge elastic and an adjacent portion of the skirt towards a central area of the opening, so as to pull the skirt away from said top panel and to provide a close fit between the mattress and the cover.

23 Claims, 5 Drawing Sheets

MATTRESS COVER

FIELD OF THE INVENTION

This invention relates to mattress covers, and more particularly, to a mattress cover capable of accommodating a variety of mattresses having different thickness or depth.

BACKGROUND OF THE INVENTION

A great variety of mattresses have been used by modern consumers. Among them the most popular nominal sizes are: king, queen, double, twin etc. Although, the peripheral dimensions of the mattresses in each nominal size category are constant, the thickness or depth dimensions of the mattresses even within the same category may differ substantially. For example, the thickness of the mattresses within the same nominal size can vary from about 5 inches to about 15 inches. Therefore, it is quite difficult to make a conventional mattress cover which fits all different thickness or depth dimensions of the mattresses in the same nominal group. In view of excessive material, a conventional cover does not typically fit tightly on a thin mattress, so that even with extensive tucking, such covers sag, wrinkle and hang loosely on the bed, often allowing the cover to slip relative to the mattress. On the other hand, a thick mattress typically requires extra material for the cover, so that it does not pull out from the underside of the mattress. Yet another problem with conventional, fitted mattress covers is the gathering of fabric in corner areas, resulting in the formation of sloppy looking wrinkled areas of material. This typically occurs when a conventional size cover is applied to a thin mattress. Furthermore, as a result of movement of the occupant of the bed of which the mattress forms a part, it is often quite difficult to prevent motion of the conventional mattress cover in general and its bottom portion in particular relative to the mattress.

Various approaches have been taken toward resolving the above-mentioned problems. For example, U.S. Pat. No. 5,249,322 to Seago provides a fitted mattress cover having a peripheral skirt which includes a layer of fabric material with a great plurality of parallel, spaced apart elastic cords stitched into the skirt fabric to gather the fabric material into folds positioned perpendicular to the longitudinal axis of the elastic cords. It is obvious from the disclosure of the Seago patent that manufacturing of such mattress cover in general and its skirt portion in particular is quite complicated, time consuming and significantly adds to the overall cost of this bedding feature.

U.S. Pat. No. 2,162,755 to Shauer et al. teaches a mattress covering bed sheet for preventing the formation of wrinkles as well as undesirable gathering of fabric. For this purpose, Shauer suggests use of triangular gussets situated at each corner of retaining flaps positioned on the underside of the mattress. However, the triangular gussets should be manually tucked and pulled when the sheet is applied in order to eliminate wrinkles and bunching of the fabric. Attaching of the gussets to the fabric of the bed covering sheet requires a laborious manufacturing operation. Finally, in view of a relatively stiff nature of material used for making the gussets, storage of this type of bed covers requires extra space and can be complicated.

Thus, there has been a considerable need for a universal, simple, inexpensive and reliable mattress cover which is capable of accommodating different thickness of the mattresses in the same nominal size category without resulting in a sloppy fit between the cover and the mattress.

SUMMARY OF THE INVENTION

One aspect of the present invention provides a mattress cover which preferably includes top panel means, skirt means, edge elastic means and peripheral elastic means. The top panel means is adopted for covering at least a substantial portion of a top surface of the mattress. The skirt means extends outwardly from the top panel means and forms an enclosure for at least portions of side, end and bottom surfaces of the mattress. The skirt means has at least a distal edge remote from the top panel means and an opening is provided in the continuous enclosure, situated at the distal edge. The edge elastic means forms a resilient boundary of the opening. The peripheral elastic means is involved in urging the edge elastic means and an adjacent portion of the skirt means towards the central area of the opening, so as to pull the skirt means away from the top panel and to provide a close fit between the mattress cover and the mattress.

In the preferred embodiment of the invention, the edge elastic means extends along the entire length of the distal edge. The peripheral elastic means comprises a plurality of elastic straps spaced apart along the resilient periphery of the opening. Typically, said plurality of elastic straps contains at least four straps. Each elastic strap resiliently interconnects at least two spaced regions in such manner that ends of each elastic strap are fixedly connected to a corresponding region situated at the distal edge or on the elastic means. The mattress cover is positioned on the mattress in such a manner that when the skirt means overlies the bottom surface of the mattress, a peripheral lip portion is formed extending in the direction of the center of the mattress.

In another aspect of the invention, the mattress cover is positioned on the mattress in such a manner that each elastic strap engages an adjacent corner of the mattress, whereas the edge elastic means surrounds side and end surfaces of the mattress and is spaced from the bottom surface of the mattress.

BRIEF DESCRIPTION OF THE DRAWINGS

Other advantages and features of the invention are described with reference to exemplary embodiments, which are intended to explain and not to limit the invention, and are illustrated in the drawings in which.

DETAILED DESCRIPTION OF THE PREFERRED EMBODIMENT

Although specific embodiments of the invention will now be described with reference to the drawings, it should be understood that the embodiments shown are by way of examples only and merely illustrative of but few of many possible specific embodiments which represent application of the principles of the invention. Various changes and modifications obvious to one skilled in the art to which the invention pertains are deemed to be within the spirit, scope and contemplation of the invention as further defined in the appended claims.

Figure 1:
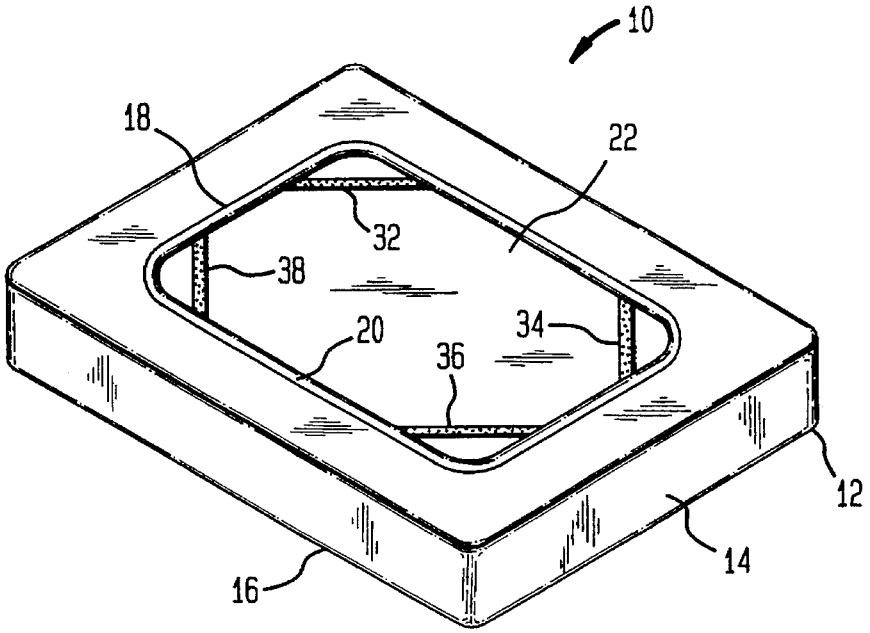
FIG. 1 is a semi-perspective view of a mattress cover of the present invention in an inverted position.
Figure 5:
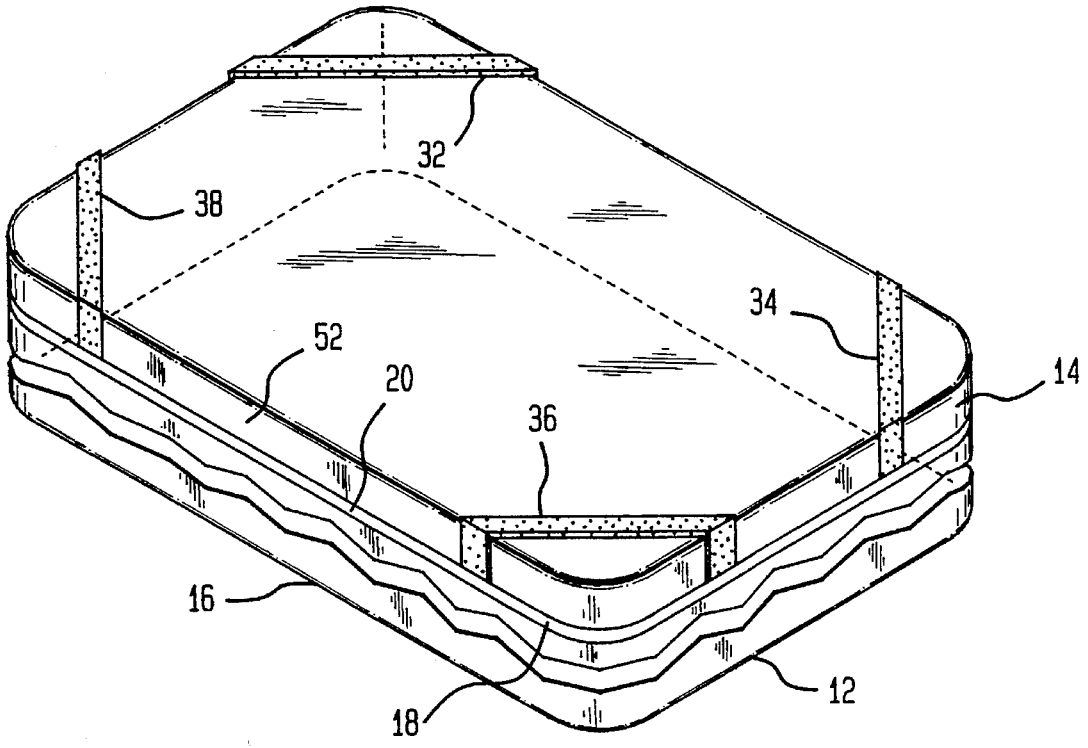
FIG. 5 is an inverted, semi-perspective view showing application of the mattress cover of the present invention to an extra-thick mattress.

FIGS. 1 and 5 illustrate a preferred embodiment of a mattress cover 10 of the present invention. The mattress cover comprises top panel means or a top panel 12 and skirt means or a skirt portion 14 extending outwardly from an outside periphery of the top panel. The top panel 12 is formed having a substantially rectangular configuration and is adapted for fitting in overlaying relationship to a top part of a mattress, so that edges of the top panel extend substantially along adjacent edges of the top part of the mattress. The skirt portion 14 has a proximal edge 16 contiguous with the edges of top panel 12, and a distal edge 18 remote from the top panel. Thus, skirt portion 14 extends between its proximal 16 and distal 18 edges forming a continuous enclosure for at least portions of sides and ends of the mattress. Edge elastic means or edge elastic member 20 is provided along the distal edge 18 of the skirt portion, so as to define an open bottom area or opening 22. The edge elastic member 20 gathers a fabric of the skirt portion at the open bottom area, forming its resilient boundary.

In the preferred embodiment the top panel 12 as well as the skirt portion 14 are made of relatively nonextendable conventional fabrics. The top panel is typically made of polycotton, cotton, etc. The material for the skirt portion may be selected from a wide group of fabrics, including, but not limited to, polycotton, cotton, nylon, etc.

In the preferred embodiment the skirt means or skirt portion 14 is typically made of a single piece of fabric forming fitted, without corners, continuous enclosure for corresponding parts of the mattress. The proximal edge 16 of the skirt portion is attached to the corresponding edges of the top panel by any suitable means, such as for example, sewing or stitching. Any conventional elastic material may be employed for fabrication of the edge elastic member. The elastic can be enclosed with tape of some sort of material, such as knitted cotton fabric, to provide a soft and attractive connection between the edge elastic member 20 and the distal edge 18 of the skirt portion.

The edge elastic means or edge elastic member provides elasticity around a lower part of the skirt portion to facilitate positioning of the mattress cover over the mattress.

Figure 11:
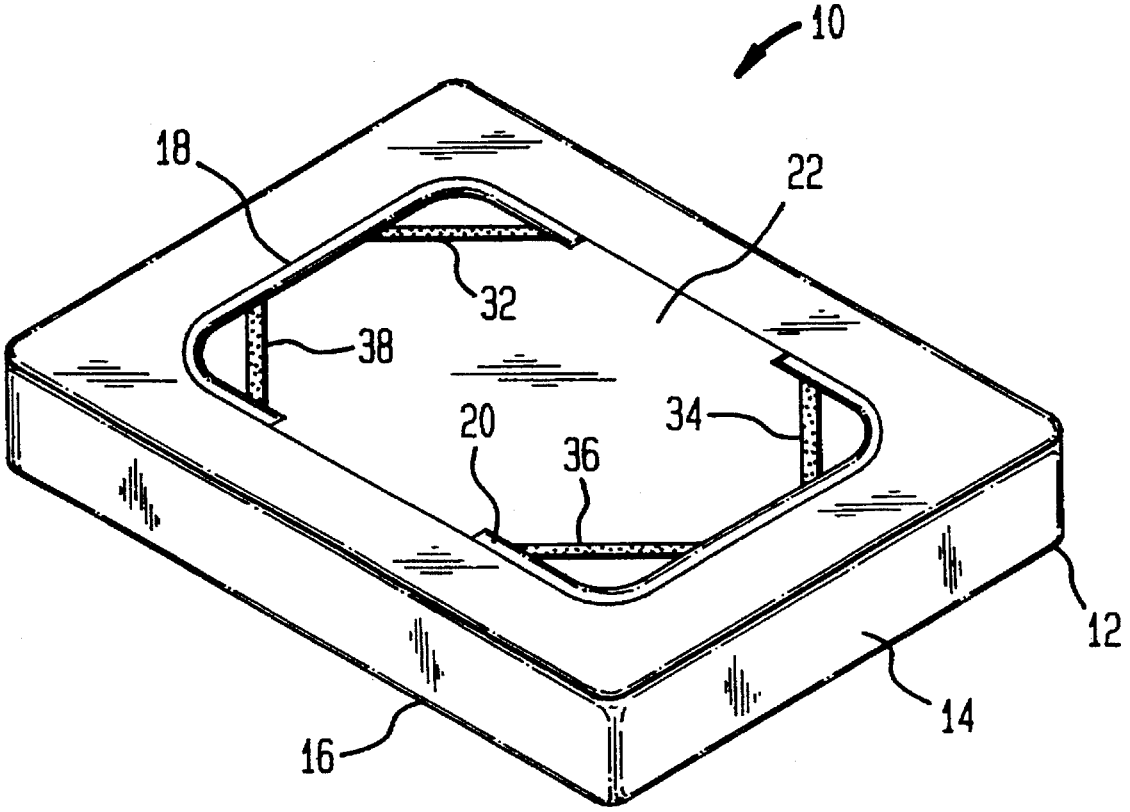
FIG. 11 is another semi-perspective view of the mattress cover having a partial elastic arrangement.

FIG. 11 illustrates edge elastic means extending partially along the distal edge of the mattress cover.

Figure 4:
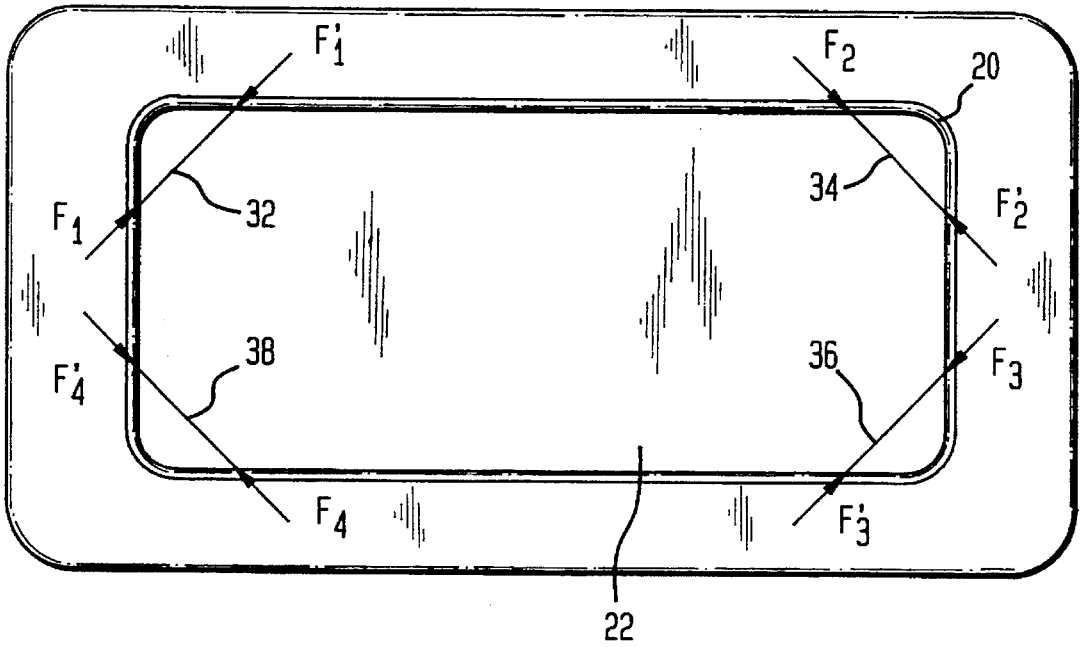
FIG. 4 shows a bottom plan view of the mattress cover positioned on the mattress and illustrates a schematic diagram of the forces applied by the peripheral elastic means to the area of the edge elastic member.

To maintain the mattress cover of the invention in proper orientation and to snap in the required, working position when placed on the mattress, peripheral elastic means is provided. It is shown in FIGS. 1, 4 and 5 that the peripheral elastic means of the preferred embodiment comprises four elastic straps 32, 34, 36 and 38 which are spaced apart along the resilient periphery of the opening 22 bound by the edge elastic means 20. Ends of each elastic strap are securely attached by any conventional means to the edge elastic means or member.

When the mattress cover of the invention is positioned on the mattress, the continuous enclosure formed by the skirt portion 14 becomes substantially rectangular in configuration conforming to the shape of end, side and bottom parts of a particular mattress. The nonextendable top panel 12 is generally commensurate with the top part of the mattress facilitating close engagement between these elements. When the skirt is placed over the exterior of other than extra thick mattress (see FIGS. 2 and 3), it is initially pulled in the direction of its depth or thickness, and the distal edge 18 of skirt 14 is placed underneath the mattress, so the opening 22 bound by a resilient periphery of the edge elastic member is situated substantially within a central part of the bottom portion of the mattress. The edge elastic member 20 is involved in initial pulling of the lower part of the skirt portion towards a center of the mattress, while the lower part of skirt portion is placed at the bottom of the mattress. The elastic straps of the peripheral elastic means sustain this pulling action and to a large degree involved in retaining the distal edge at a center of the mattress during use of the mattress cover. Consequently, the elastic straps of the peripheral elastic means urge the lower part of the skirt portion and the opening bound by the edge elastic member to remain centrally on the underside of the mattress. This tends to pull the skirt portion over the exterior of the mattress, urging the skirt to fit snugly around the ends, sides and against the bottom of the mattress.

Thus, the elastic straps 32, 34, 36 and 38 of the peripheral elastic means in combination with the edge elastic means 20 enable the present invention to retain the lower part of the skirt portion at a center of the mattress, substantially preventing undesirable movements of the lower part of the skirt portion about the mattress in general and the bottom part thereof in particular.

Figure 2:
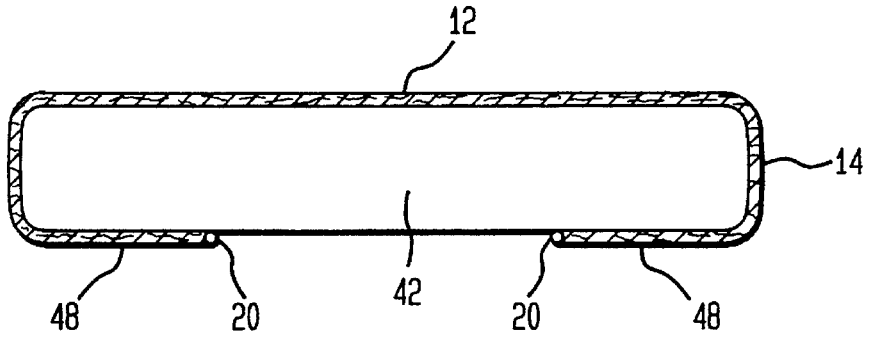
FIG. 2 is a semi-sectional, side, elevational view showing an application of the mattress cover to a shallow mattress.
Figure 3:
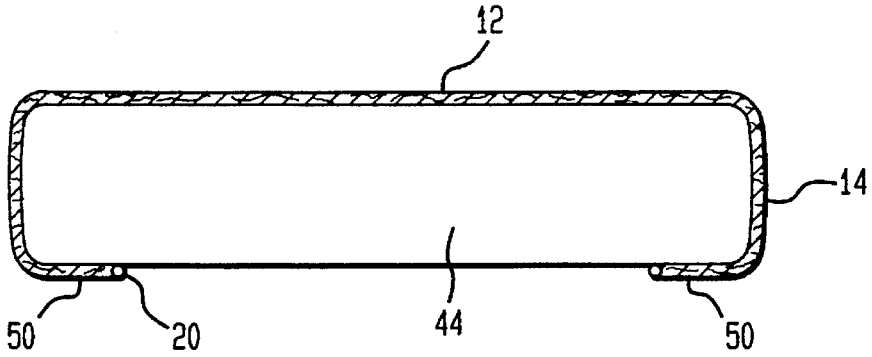
FIG. 3 is a semi-sectional, side, elevational view illustrating an application of the mattress cover to a mattress having thickness greater than the mattress of FIG. 2.
Figure 6:
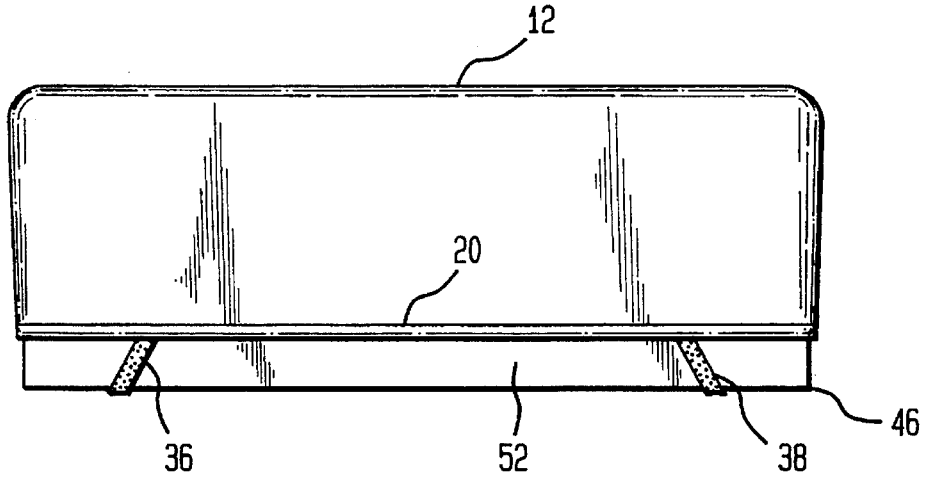
FIG. 6 is a side, elevational view of the mattress cover and the mattress of FIG. 5.

The ability of the mattress cover of the present invention to fit mattresses of variable thickness or depth is illustrated in FIGS. 2, 3 and 6. A relatively shallow mattress 42 of a selected nominal size is illustrated in FIG. 2. The mattress cover 12 is positioned on the mattress in such a manner that the skirt 14 overlapping the underside of the mattress forms an overlying peripheral lip portion 48 which extends to a substantial degree in the direction of the center of the mattress along its underside.

FIG. 3 depicts a mattress 44 of the same nominal size as the mattress 42 of FIG. 2. However, the thickness of the mattress 44 is greater than the thickness of the mattress 42. The same cover is applied to both mattresses. It is shown in FIG. 3 that the mattress cover conforms to the shape of the mattress by providing a snug fit between the cover and the exterior of the mattress. However, the distance which a peripheral lip 50 of FIG. 3 extends under the mattress is substantially smaller than that of FIG. 2.

In FIGS. 2 and 3, the edge elastic member provides the initial pull of the lower part of the skirt including the peripheral lip portion in the direction of the center of the mattress. In this application of the mattress cover, the elastic straps of the peripheral elastic means cooperate with the edge elastic member by tightening the pull of the skirt against the outside periphery of the mattress, causing the skirt portion to closely engage the end, side and bottom surfaces of the mattress regardless of its thickness or depth.

FIG. 4 represents a schematic diagram of the forces generated by the elastic straps of the peripheral elastic means and acting on the edge elastic member and the lower part of the skirt portion when the mattress cover of the invention is placed on the mattresses discussed with reference to FIGS. 2 and 3. F1 and F1' represent forces acting on the edge elastic member from the first elastic strap. Similarly, F2 and F2'; F3 and F3'; as well F4 and F4' (see FIG. 4) are the forces acting on the elastic member 20 from the second, third and fourth elastic straps, correspondingly. These forces tend to pull the edge elastic member 20 and the distal edge inwardly and to reduce the outside periphery of the opening 22. As a result, the distal edge and the lower part of the skirt are forced inwardly towards the center of the mattress by pulling the peripheral lip portion in the same direction. Thus, the peripheral elastic means in general and the elastic straps in particular, while positioned underneath the mattress, help to pull the distal edge and the edge elastic member in the direction of the mattress center which enables the invention to hold the cover in place and to take up or pull any excess material beneath the mattress, regardless of its thickness or depth.

An application of the cover of the present invention to an extra-thick mattress 46 of the same nominal size as the mattresses of FIGS. 2 and 3 is depicted in FIGS. 5 and 6. In FIG. 6 similar to the above-described FIGS. 2 and 3, the top portion and the skirt is adapted to closely fit around the top surface of the mattress. The thickness of the mattress 46 is greater than the length of the skirt portion. Therefore, no peripheral lip portion overlying the underside of the mattress is present. Instead, FIGS. 5 and 6 show a gap 52 between the edge elastic member 20 and the bottom of the mattress. The edge elastic member 20 situated at the distal edge of the skirt portion tends to provide a fit engagement between the lower end of the skirt and the lower part of the mattress. The elastic straps of the peripheral elastic means extending under corresponding corners of the mattress and around its lower edges pull the skirt portion downward and retain the mattress cover in the stretched position on the mattress.

Figure 7:
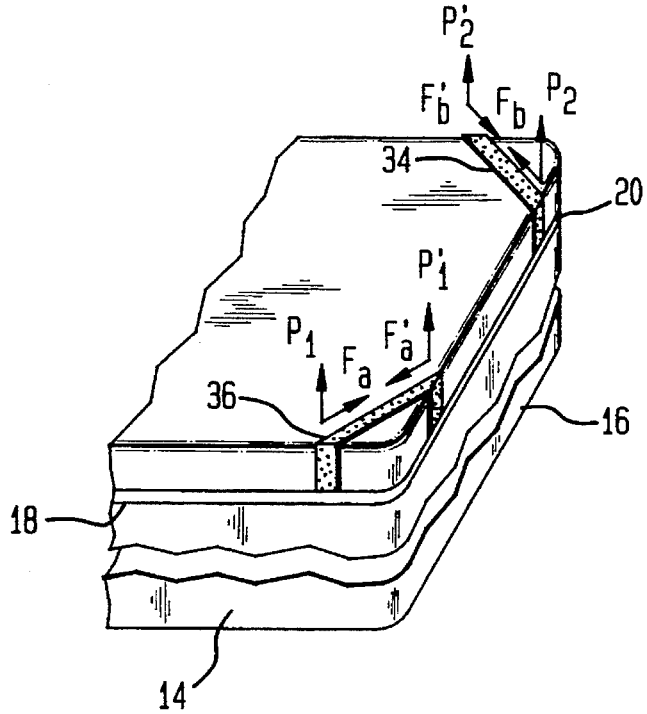
FIG. 7 is a partial schematic diagram of the forces generated by peripheral elastic means of FIG. 5.

As to the application of the mattress cover of the invention to the extra-thick mattress (see FIGS. 5 and 6), a schematic diagram of the forces applied by the peripheral elastic means in general and the elastic straps in particular to the lower part of the skirt portion is shown in FIG. 7. P1 and P1' as well as P2 and P2' reflect the pulling forces generated in the substantially vertical direction by the elastic straps 34 and 36, respectively, to the lower part of the skirt portion. Fa and Fa' as well as Fb and Fb' represent forces generated by the elastic straps 44 and 36, respectively, in the substantially horizontal direction. In this application, the edge elastic member 20, surrounding the outside periphery of the ends and sides of the mattress, provides only marginal, frictional forces between the mattress and the cover. Although the role of each above-identified force has not been completely determined, it appears that the substantially vertically directed pulling forces (P1, P1', P2 and P2') are involved in stretching the skirt portion away from the top panel, whereas the substantially horizontally directed forces (Fa, Fa', Fb and Fb') are involved in retaining the elastic straps in their secured position as illustrated in FIG. 7.

The elastic straps are sufficiently resilient and stretchable so that the mattress cover can be removed from the mattress without undue strain to the elastic material or the fabric of the cover. In removing the cover from the mattress, the elastic straps and the edge elastic member permit the skirt portion to be completely pulled from beneath the mattress. The resiliency of the elastic straps allow the invention to pull the skirt without undue tucking.

In another embodiment of the invention, the skirt portion can be made of a material marginally extendable in the direction of the depth or thickness of the mattress. Therefore, the skirt portion may be slightly stretched in this direction to adjust for minor variations in the depth dimension and to fit snugly over the sides of the mattress, around and under its bottom edges. In this embodiment the material for the skirt portion may be chosen from a group of extendable fabrics, including, but not limited to, doubleknit fabrics, 100% polyester, etc. The skirt portion can be formed having a plurality of flaps, wherein each such flap is designed to accommodate a particular part of the mattress; i.e., sides, ends, etc.

Figure 8:
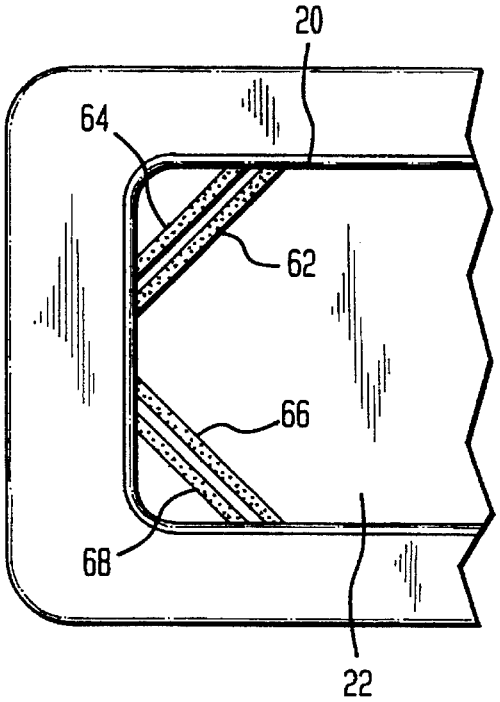
FIG. 8 illustrates another embodiment of the elastic straps of the peripheral elastic means.
Figure 9:
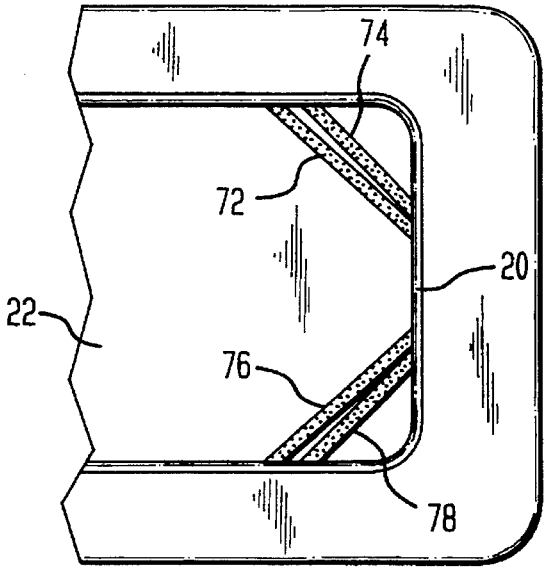
FIG. 9 illustrates a further embodiment of the elastic straps of the peripheral elastic means.

FIGS. 8 and 9 illustrate the embodiments of the invention in which each elastic strap consists of a plurality of elastic elements. For example, in the embodiment of FIG. 8 one elastic strap consists of the elastic elements 62 and 64, whereas another elastic strap includes elastic elements 66 and 68. As illustrates in FIG. 8, in the expanded position of the mattress cover, the elastic elements of each strap expand substantially parallel to each other. In the embodiment of FIG. 9, the elastic elements of each strap are positioned at an angle to each other. For example, the elastic element 74 is positioned at an acute angle to the elastic element 72, whereas the elastic elements 76 and 78 also form an angle.

Figure 10:
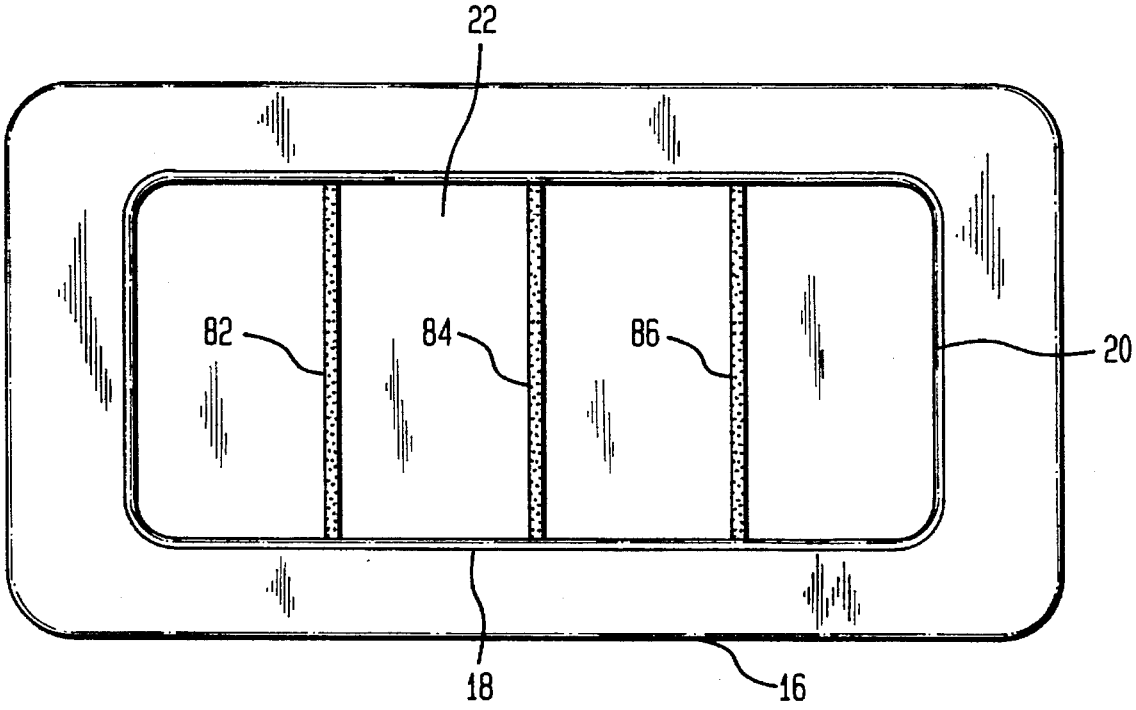
FIG. 10 illustrates a still further embodiment of the invention.

FIG. 10 illustrates the embodiment of the invention in which in the working position of the cover 12, elastic straps 82, 84 and 86 extend along the width of the mattress and can be substantially perpendicular to the proximal edge 16. Ends of these elastic straps are either fixably or detachably connected to the distal edge 18 or to the edge elastic 20.

I claim:

1. A mattress cover for covering a mattress having at least a top, bottom, end and side surfaces, said mattress cover comprising:

top panel means for covering at least a substantial portion of said top surface of the mattress;

skirt means extending outwardly from said top panel means and forming an enclosure for at least portions of said side and end surfaces of said mattress, said skirt means having at least a distal edge remote from said top panel means, said enclosure having an opening situated at said distal edge, said opening having at least a central area;

edge elastic means for forming a resilient boundary of said opening; and peripheral elastic means for urging said edge elastic means and adjacent portion of said skirt towards said central area, so as to pull said skirt means away from said top panel and to provide a close fit between said mattress cover and said mattress, said peripheral elastic means comprises a plurality of elastic strips spaced apart along said resilient periphery of said opening, each said elastic strip consists of a pair of elastic elements.

2. The mattress cover of claim 1, wherein said edge elastic means extends along the entire length of said distal edge.

3. The mattress cover of claim 1, wherein said edge elastic means extends partially along said distal edge.

4. The mattress cover of claim 1, wherein said plurality contains at least four straps.

5. The mattress cover of claim 1, wherein each said elastic strap resiliently interconnects at least two spaced regions positioned at said distal edge.

6. The mattress cover of claim 5, wherein each said elastic strap resiliently interconnects at least two spaced regions on said elastic means.

7. The mattress cover in claim 6, wherein said ends of each said elastic strap are fixedly connected to said corresponding regions on said elastic means.

8. The mattress cover of claim 6 in combination with the mattress, wherein said mattress cover is positioned on said mattress in such a manner that said opening is adjacent to said bottom surface of the mattress.

9. The mattress cover of claim 6 in combination with the mattress, wherein said mattress further comprises of at least four corners forming a part of at least said bottom surface, said mattress cover is positioned on said mattress in such a manner that each said elastic strap engages said adjacent corner of said mattress.

10. The mattress cover in claim 9 in combination with the mattress, wherein said edge elastic means surrounds said side and end surfaces and is spaced from said bottom surface of the mattress.

11. The mattress cover of claim 1, wherein in stretched position of said mattress cover said elastic elements expand substantially parallel to each other.

12. The mattress cover of claim 1, wherein in a stretched position of said mattress cover said elastic elements are positioned at an acute angle to each other.

13. The mattress cover of claim 1, wherein said skirt means is made of a nonextendable fabric.

14. The mattress cover of claim 1, wherein said skirt means is made of extendable fabric.

15. The mattress cover of claim 1, wherein said enclosure formed by said skirt means is a continuous enclosure made of a single piece of fabric without corners.

16. An extra-thick mattress-mattress cover combination comprising:

an extra-thick mattress having at least top, bottom end and side surfaces;

a mattress cover consisting of top panel means for covering at least a substantial portion of said top surface of the mattress, skirt means extending outwardly from said top panel means and forming an enclosure for at least portions of said side and end surfaces of said mattress, said skirt means having at least a distal edge remote from said top panel means, said continuous enclosure having an opening situated at said distal edge, said opening having at least a central area, the depth of said side and end surfaces of the mattress exceeds the depth of said skirt means, so that in a working condition of said mattress cover a space is formed between said distal edge of said skirt means and the bottom surface of the mattress, edge elastic means for forming a resilient boundary of said opening, and peripheral elastic means for urging said edge elastic means and an adjacent portion of said skirt means towards said bottom surface of the mattress, so as to pull said skirt means away from said top panel and to provide a close fit between said mattress cover and said mattress, said peripheral elastic means comprises a plurality of elastic straps spaced apart along said resilient periphery of said opening, whereby in said working condition each said elastic strap extends along said space and said bottom surface of the mattress.

17. The combination of claim 16, wherein said mattress further comprises four bottom corners forming a part of said bottom surface, and in said working condition each said elastic strap engages said corresponding bottom corner.

18. The combination of claim 16 wherein said edge elastic means extends at least partially along said distal edge.

19. The combination of claim 16, wherein each said elastic strap has two ends and said ends of each said elastic strap are fixedly connected to corresponding regions of said elastic means.

20. The combination of claim 19, wherein each said elastic strap resiliently interconnects at least two spaced regions positioned at said distal edge.

21. The combination of claim 20, wherein each said elastic strap resiliently interconnects at least two spaced regions on said elastic means.

22. The combination of claim 19, wherein each said elastic strap comprises a pair of elastic elements.

23. The combination of claim 16, wherein said plurality contains at least four straps.

* * * * *